US007189289B2

(12) United States Patent
Oh et al.

(10) Patent No.: US 7,189,289 B2
(45) Date of Patent: Mar. 13, 2007

(54) CLEANING AGENT AND METHOD FOR CLEANING HEATER TUBES

(75) Inventors: Jeon-Keun Oh, Daejeon (KR); Wha-Sik Min, Daejeon (KR); Sam-Ryong Park, Ulsan (KR); Gi-Won Park, Ulsan (KR)

(73) Assignee: SK Corporation, Seoul (KR)

( * ) Notice: Subject to any disclaimer, the term of this patent is extended or adjusted under 35 U.S.C. 154(b) by 0 days.

(21) Appl. No.: 10/503,302

(22) PCT Filed: Feb. 6, 2003

(86) PCT No.: PCT/KR03/00266

§ 371 (c)(1),
(2), (4) Date: Aug. 3, 2004

(87) PCT Pub. No.: WO03/066795

PCT Pub. Date: Aug. 14, 2003

(65) Prior Publication Data

US 2005/0143279 A1 Jun. 30, 2005

(30) Foreign Application Priority Data

Feb. 8, 2002 (KR) ..... 10-2002-0007517

(51) Int. Cl.
*B08B 7/02* (2006.01)

(52) U.S. Cl. ..... 134/6; 134/7; 134/8; 134/22.1; 134/22.11; 134/34; 134/26; 134/40

(58) Field of Classification Search ..... 510/109, 510/247, 375; 134/6, 7, 8, 22.1, 22.11, 26, 134/40, 42, 34
See application file for complete search history.

(56) References Cited

U.S. PATENT DOCUMENTS 3,379,496 A * 4/1968 Russo ..... 423/267

(Continued)

FOREIGN PATENT DOCUMENTS

EP 0070056 * 1/1983

(Continued)

*Primary Examiner*—Sharidan Carrillo
(74) *Attorney, Agent, or Firm*—Clark & Brody

(57) ABSTRACT

Disclosed is a cleaning agent for heater tubes, which is capable of eliminating deposits such as soot particulates in tubes installed in industrial heaters that typically use oil, coal or gas. The cleaning agent of the present invention is prepared by formulating a chemical composition comprising ammonium nitrate into pellets. Also, the present invention discloses a method of cleaning heater tubes using the cleaning agent. When being utilized for cleaning the heater tubes, the cleaning agent can improve mechanical and chemical cleaning effects, thus shortening of working time and reducing a required amount of the chemical composition, as well as preventing rapid evaporation of the chemical composition, thus increasing cleaning effect. In addition, the cleaning agent can eliminate the cementing effect of sulfur oxides or vanadic oxides in the heater tubes and thus control stably emission of $NO_x$, by selectively containing other additives including magnesium and urea.

9 Claims, 2 Drawing Sheets

U.S. PATENT DOCUMENTS 3,533,776 A * 10/1970 Coates et al. ..... 71/28
3,540,953 A * 11/1970 Schulze et al. ..... 149/2
3,660,182 A * 5/1972 Cook et al. ..... 149/46
4,316,736 A * 2/1982 Van Hijfte et al. ..... 71/59
4,396,434 A * 8/1983 Forster ..... 134/1
4,409,016 A * 10/1983 Mutsers et al. ..... 71/59
4,486,396 A * 12/1984 Kjohl et al. ..... 423/265
4,736,683 A * 4/1988 Bachman et al. ..... 102/290
5,290,962 A * 3/1994 Ozdoba et al. ..... 516/109
5,596,168 A * 1/1997 Menke et al. ..... 149/19.4
5,675,119 A * 10/1997 Otani et al. ..... 149/39
5,938,813 A * 8/1999 Araya et al. ..... 71/30
6,059,906 A * 5/2000 Fleming et al. ..... 149/19.92
2003/0099589 A1* 5/2003 Hero et al. ..... 423/396
2005/0143279 A1* 6/2005 Oh et al. ..... 510/444

FOREIGN PATENT DOCUMENTS

EP 0229421 * 7/1987
GB 1001772 8/1965
GB 1189448 * 4/1970
GB 1249371 10/1971

* cited by examiner

FIGURE

CLEANING AGENT AND METHOD FOR CLEANING HEATER TUBES

TECHNICAL FIELD

The present invention, generally, relates to a cleaning agent and a method for cleaning heater tubes. In particular, the present invention is directed to a cleaning agent for removing deposits such as soot particulates deposited in tubes that are installed in industrial heaters, furnaces and boilers, and a method for on-line cleaning of heater tubes using such a cleaning agent.

PRIOR ART

In the case of industrial heaters, furnaces, boilers, and so forth (hereinafter, representatively referred to as "heaters"), which typically use oil, coal and gas, deposits such as soot particulates are accumulated in the tubes installed therein. When being attached strongly and thus accumulated in the tubes, such deposits can inhibit heat transfer in the heaters, resulting in a great economic loss, waste of energy, increase of environmental pollution, and occurrence of accidents and reduction of production efficiency by overloading of the heaters. Such deposits are formed when incombustible carbons such as soot particulates, are adhered to internal surfaces of the heater tubes by sulfur oxides or vanadium oxides acting as a binder.

The deposits can be removed from the heater tubes after shutdown or interruption of the main process. However, this kind of method of removing the deposits suffers from the economic loss since high cost is required for shutdown, re-startup and maintenance of the process.

Aiming at removal of the deposits, on-line cleaning techniques were developed, which periodically or continuously remove the deposits from operating heaters using oxidants such as potassium nitrate or ammonium nitrate under a high temperature.

For example, GB Pat. No. 1,001,772 discloses a method of chemically cleaning tubes coated with soot or other carbons, using a non-explosive agent consisting of a mixture comprising potassium nitrate and one or more combustible materials which include element carbon or a material containing carbon in free or chemically combined form, said the mixture having oxygen overbalance within 8–35% and the content of element carbon or chemically combined carbon in the agent amounting to 1–4 wt %. According to the above patent, after being injected to an upper part over flame of a boiler, combusted and then accumulated on the inner surface of the boiler tube, the agent burns carbon compounds and neutralizes sulfur oxides, thereby eliminating the binder property of the sulfur oxides.

In addition, GB Pat. No. 1,249,371 to the Swedish company "Bejs I Vaesteras" at 1969, entitled in "A Method for Chemically Cleaning Surfaces Coated with Soot in Boilers", discloses a method of improving cleaning effect in boiler tubes by directly injecting the same chemical composition as in the GB Pat. No. Î,001,772 to the boiler flame after being mixed with air in a powder or micro-particle form.

The cleaning effect in the heater tubes can be further improved by blasting an oxidant and sand on surfaces to be cleaned in operating heaters at a high speed of 100–250 m/s, as proposed by French CTP company at 1989, in which the oxidant is selected from oxides of chrome, manganese, sulfur, nitrogen or boron, peroxides and salts thereof, nitrate, nitrite, and ammonium nitrate, and applied in a fine granule form of 0.5–2.5 mm.

However, the conventional cleaning agents are not effective in removing deposits in the heater tubes, in addition to increasing generation of nitrogen oxides ($NO_x$) to levels exceeding limits permitted by law, thus causing serious environmental problems. Therefore, there is a need for development of various and effective cleaning agents for the heater tubes.

DISCLOSURE OF THE INVENTION

Leading to the present invention, the distinct and thorough research conducted by the present inventors to develop a cleaning agent having excellent cleaning effect for heater tubes, taking the problems encountered in the prior art into consideration, resulted in the finding that a cleaning agent comprising ammonium nitrate of the pellet form with specific physical properties shows an improved cleaning effect for heater tubes coated with deposits such as soot.

It is therefore an object of the present invention to provide a cleaning agent for heater tubes, which is capable of enhancing mechanical cleaning effect for heater tubes using solid pellets having a large particle diameter, shortening working time and reducing the amount of used cleaning agent through the combinational action of the mechanical cleaning effect of the pellets and their chemical cleaning effect, and expanding the cleaning area and improving the cleaning effect of the cleaning agent by preventing rapid evaporation of the cleaning agent and thus transporting the pellets far from a worker doing the cleaning work, as well as effectively removing deposits such as soot in the heater tubes by a sand blasting effect and stably controlling generation of nitrogen oxides ($NO_x$).

It is another object of the present invention to provide a method of cleaning the heater tubes using the cleaning agent.

In one aspect of the present invention, there is provided a cleaning agent for heater tubes, comprising ammonium nitrate and formulated as pellets having an average particle diameter of 2.5–8 mm and a particle density of 1.5–2 g/cm$^3$.

In another aspect of the present invention, there is provided a method of cleaning heater tubes, comprising blasting a cleaning agent comprising ammonium nitrate in a pellet form having an average particle diameter of 2.5–8 mm and a particle density of 1.5–2 g/cm$^3$ by a sand blasting technique onto the surface in the heater tubes at an injection pressure of 1–20 kg/cm$^2$ using air or nitrogen as a carrier medium.

BRIEF DESCRIPTION OF THE DRAWINGS

The above and other objects, features and other advantages of the present invention will be more clearly understood from the following detailed description taken in conjunction with the accompanying drawings, in which.

BEST MODES FOR CARRYING OUT THE INVENTION

Figure 1:
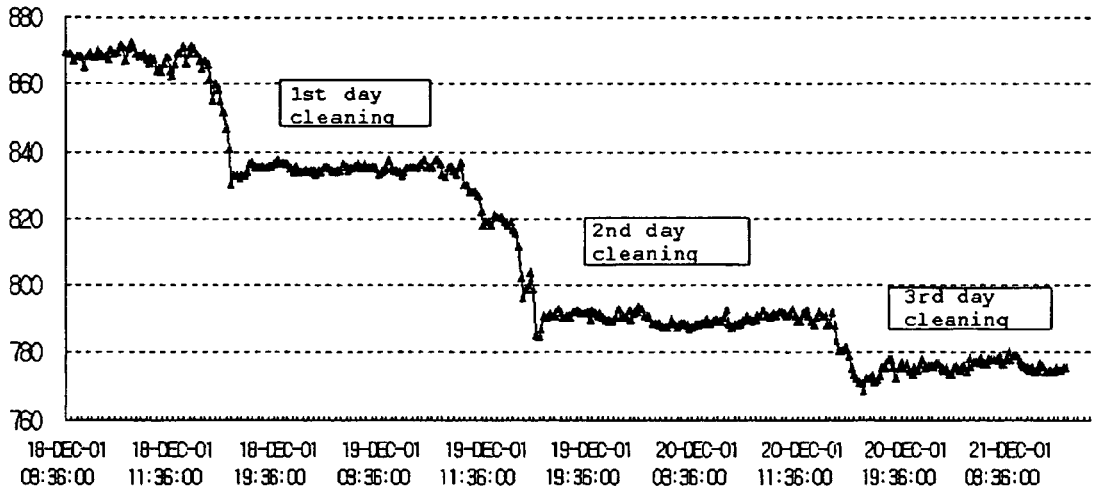
FIG. 1 is a graph showing a reduction in temperature at a heater's radiant as a function of time when cleaning a heater using a cleaning agent for heater tubes according to the present invention.

According to the present invention, a cleaning agent for removing deposits such as soot adhered to the surface of the heater tubes has a pellet form. The cleaning agent of pellet form may be prepared by the conventional compression molding techniques, and using the pellets in cleaning heater tubes. As such, the cleaning agent comprises ammonium nitrate as an essential ingredient, or a specific combination of ammonium nitrate and optional ingredient such as magnesium oxide, urea, a coating agent and a binder.

In accordance with the present invention, a method of cleaning heater tubes comprises blasting a cleaning agent as described above by a sand blasting techniques, on the surface of heater tubes at an injection pressure of 1–20 $kg/cm^2$ using air or nitrogen as a carrier medium. At this time, the injection pressure is controlled by a worker, depending on a position of a part of heater tubes to be cleaned. The above range of the injection pressure is optimal for obtaining desirable cleaning effect.

The cleaning agent for heater tubes is prepared by formulating ammonium nitrate into a pellet having an average particle diameter of 2.5–8 mm, preferably 4–5 mm, and a particle density of 1.5–2 $g/cm^3$. The pellet is formed by introducing ammonium nitrate into a compression molding apparatus, and performing compression molding at room temperature and under high pressure, for example, under a pressure of 5–100 $kg/cm^2$, where temperature of materials in the compression molding apparatus is increased to their melting points. As such, the pellet may have various shapes, including a hemisphere, a cylinder, a hexahedron and a sphere, and most preferably, a sphere.

When the average particle diameter of the pellets is less than 2.5 mm, the pellets are evaporated in very short time after injection into the heaters, thus lowering their cleaning effect and migrating a shorter distance in the inside of the heaters. When the average particle diameter of the pellets is over 8 mm, the pellets also have reduced cleaning effect because it takes a longer time for the pellets to evaporate and the pellets thus fall to the bottom of the heaters.

As described above, because the cleaning agent is formulated as pellets in the solid form, the particles have a high density. When compared with the particle density of ammonium nitrate, about 1.39 $g/cm^3$, which has been used as a typical cleaning agent, the pellet according to the present invention has a particle density of about 1.5–2 $g/cm^3$. For example, in accordance with an embodiment of the present invention, a pellet containing ammonium nitrate and magnesium oxide has a particle density of 1.76 $g/cm^3$, about 27% higher than the conventionally used ammonium nitrate, 1.39 $g/cm^3$. When being sprayed into heaters, the thus prepared cleaning agent is able to shorten working time and reduce its used amount by improving the mechanical cleaning effect, thanks to its formulation as such pellets having higher density and larger size of particles than the conventional cleaning agent. Also, since the cleaning agent is formulated in the pellet form, its rapid evaporation can be prevented, thereby having superior cleaning effect to the conventional small-sized particles that are evaporated immediately after injection. Further, since the cleaning agent needs a relatively longer time to evaporate in the heaters and thus exists in a solid and liquid state for a longer period of time before evaporation, the mechanical cleaning effect, which is effected by the solid state, and reaction efficiency by the liquid state are improved, thus greatly improving its cleaning effect for deposits.

In accordance with the present invention, optionally the cleaning ant may further comprise, based on 100 parts by weight of ammonium nitrate, magnesium oxide up to 50 parts by weight, an inorganic cleaning agent up to 50 parts by weight, urea up to 200 parts by weight, a coating agent up to 5 parts by weight, a binder up to 30 parts by weight, and an anti-corrosion agent up to 10 parts by weight in the combined form with ammonium nitrate.

Magnesium oxide, optionally used in the present invention, serves to reduce the binding effect attributable to vanadium oxides, by reacting with vanadium oxides, which are known to bind to soot, and convert the deposits, which is adhered to the surface of the tubes in the heater, into a material having a high melting point. Therefore, to suppress such a binding effect, magnesium oxide may be contained in the cleaning agent at an amount of up to 50 parts by weight, preferably 1–50 parts by weight, more preferably 5–15 parts by weight, and most preferably 7–10 parts by weight, based on 100 parts by weight of ammonium nitrate.

The inorganic cleaning agent useful for further improving the cleaning effect of the cleaning agent according to the present invention is one or more selected from the group consisting of potassium nitrate, peroxides, manganese oxides, and sulfur oxides, and may be contained in the cleaning agent at an amount of up to 50 parts by weigh, preferably 1–50 parts by weight, based on 100 parts by weight of ammonium nitrate.

Meanwhile, In the case of employing the conventional typed cleaning agent for cleaning heaters, nitrogen as a component of ammonium nitrate is converted to $NO_x$ in the heaters, thereby increasing emission of $NO_x$ to over the legally permitted limits. To solve this problem, urea ($CO(NH_2)_2$) may be further added and homogeneously mixed to give a cleaning agent. That is, urea can lower the $NO_x$ production by converting $NO_x$ to $N_2$ and $H_2O$ using a selective non-catalytic reduction (SNCR) mechanism. In this regard, urea may be contained in the cleaning agent at an amount of up to 200 parts by weight, preferably 1–200 parts by weight, more preferably 20–150 parts by weight, and most preferably 40–120 parts by weight, based on 100 parts by weight of ammonium nitrate.

In accordance with alternative embodiment of the present invention, in order to accomplish the similar NOx reduction effect, 30–95 wt % of a cleaning agent comprising ammonium nitrate formulated as pellets having an average particle diameter of 2.5–8 mm and a particle density of 1.5–2 $g/cm^3$ and not containing urea may be injected into the heater together with 5–70 wt % of urea pellets having an average diameter of 1–5 mm. The amount of the urea pellet is used at an amount of up to 70 wt %, preferably 20–60 wt %, and more preferably 40–60 wt %.

The binder useful in the present invention, which is added to improve binding ability of the cleaning agent, is one or more selected from the group consisting of starch, gelatin, glue, binding agents and 3-aminopropyltriethoxysilane, and contained in the cleaning agent up to at an amount of 30 parts by weight, preferably 1–30 parts by weight, based on 100 parts by weight of ammonium nitrate.

To prevent the cleaning agent from forming an aggregation during storage or cleaning work owing to its hydrophilicity, the surface of the cleaning agent is preferably coated with a coating agent. The coating agent useful in the present invention is selected from the group consisting of formaldehyde and Mg-stearate, and contained in the cleaning agent at an amount of up to 5 parts by weight, preferably 1–5 parts by weight, based on 100 parts by weight of ammonium nitrate.

In addition, the anti-corrosion agent capable of being used to prevent corrosion of the heaters in the present invention is one or more selected from the group consisting of magnesium carbonate and calcium carbonate, and may be contained in the chemical composition at an amount of up to 10 parts by weight, preferably 1–10 parts by weight, based on 100 parts by weight of ammonium nitrate.

Thus, the cleaning agent for heater tubes according to the present invention may contain a variety of additional component(s) as described above, but is not limited to them.

Figure 3:
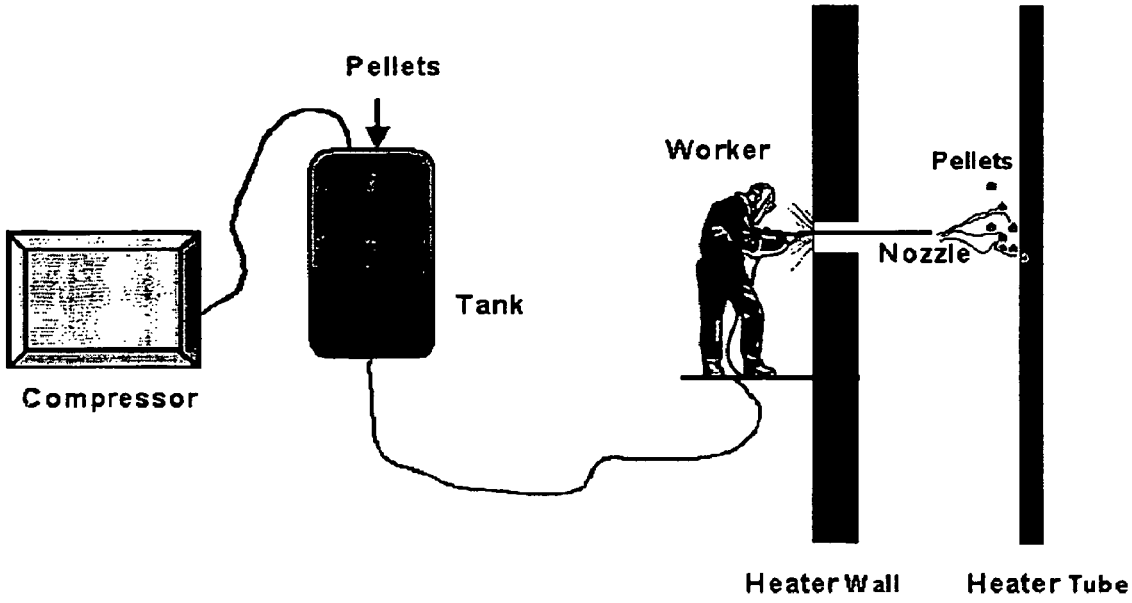
FIG. 3 is a schematic view of one embodiment for cleaning heater tubes by a sand blasting technique according to the present invention.

According to the present invention, the cleaning agent for heater tubes may be used during the operation of heater. As such, the cleaning agent can be injected into the heater using the known sand blaster. For example, as shown in FIG. 3, the heater tubes can be cleaned without interruption of the operation by blasting the cleaning agent at an injection pressure of 1–20 kg/cm$^2$ through a projection nozzle on the surface of operating heater tubes, wherein air or nitrogen is used as a carrier medium for the cleaning agent.

The present invention will be explained in more detail with reference to the following an example in conjunction with the accompanying drawings. However, the following example is provided only to illustrate the present invention, and the present invention is not limited to the example.

EXAMPLE 1

Pellets of 5 mm in average particle diameter were prepared by homogeneously mixing 100 parts by weight of ammonium nitrate, 10 parts by weight of magnesium oxide, 100 parts by weight of urea, 1 parts by weight of formaldehyde, 2 parts by weight of starch, 2 parts by weight of potassium nitrate and 5 parts by weight of magnesium carbonate, injecting the mixture into a spherical mold, and molding the mixture under a pressure of 5 kg/cm$^2$ at room temperature. 1.6 tons of the resulting pellets were applied to a heater in a No. 3 petroleum purification process, treating 170,000 barrels per day, owned by SK Corporation, Korea, and the result is given in FIG. 1. As shown in FIG. 1, by using the pellets, the surface temperature of tubes at the radiant provided at the upper portion of the heater was found to be rapidly reduced, indicating that the pellet has an excellent cleaning effect.

Comparative Example 1

A heater was cleaned using the conventional ammonium nitrate cleaning agent by the conventional cleaning method, where the conventional cleaning agent was injected at an amount of 10 tons, which is over 4 times the amount of cleaning agent used in Example 1. The result is given in FIG. 1.

Figure 2:
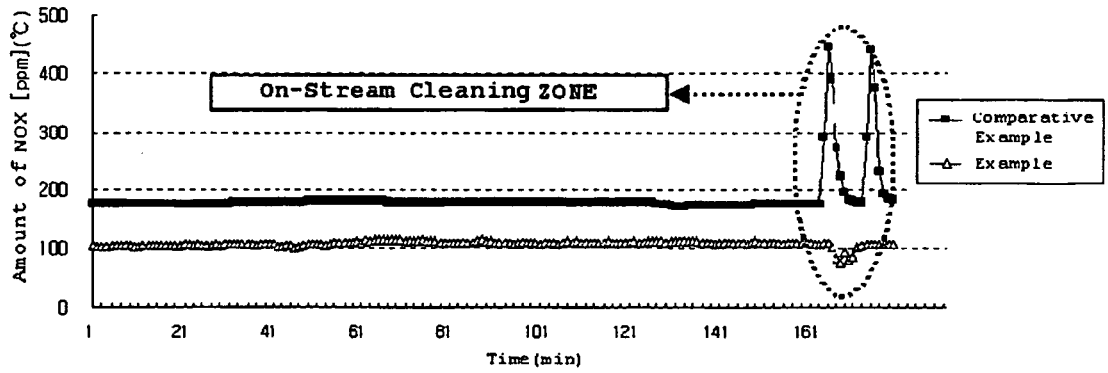
FIG. 2 is a graph comparing an amount of produced $NO_x$ when using a cleaning agent for heater tubes according to the present invention (Example) to that when using the conventional cleaning agent (Comparative Example)

Also, Each of the pellet composition (Example 1) and the conventional cleaning agent (Comparative Example 1) was injected to the operating heater, and the amount of generated $NO_x$ was measured and the result is given in FIG. 2. As shown in FIG. 2, with the Comparative Example, the generated amount of $NO_x$ was found to exceed a legally permitted limit, 250 ppm. In contrast, when the pellets were injected, the generation of $NO_x$ was reduced.

INDUSTRIAL APPLICABILITY

As apparent in the above Example and Comparative Example, when being utilized for cleaning the heater tubes, the cleaning agent according to the present invention has improved mechanical cleaning effect, thus shortening working time and reducing a required amount of the cleaning agent, as well as preventing rapid evaporation of the cleaning agent, thus increasing cleaning effect. In addition, the cleaning agent can counteract the binding effect of sulfur oxides or vanadium oxides in the heater tubes and thus stably control emission of $NO_x$, by optionally containing other additional component(s) including magnesium, urea and the like.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

The invention claimed is:

1. A method for on-line cleaning of heater tubes, comprising blasting, by a sand blasting technique, a cleaning agent comprising ammonium nitrate, formulated as a pellet having an average particle diameter of 2.5–8 mm and a particle density of 1.5–2 g/cm3, to operating heater tubes at an injection pressure of 1–20 kg/cm2 using air or nitrogen as a carrier medium.

2. The method as set forth in claim 1, wherein the cleaning agent further comprises 1–50 parts by weight of magnesium oxide, and 1–50 parts by weight of inorganic cleaning agent which is one or more selected from the group consisting of potassium nitrate, peroxides, manganese oxides and sulfur oxides, based on 100 parts by weight of said ammonium nitrate.

3. The method as set forth in claim 1, wherein the cleaning agent further comprises 1–200 parts by weight of urea based on 100 parts by weight of ammonium nitrate.

4. The method as set forth in claim 1, wherein the cleaning agent further comprises 1–50 parts by weight of magnesium oxide, 1–50 parts by weight of inorganic cleaning agent which is one or more selected from the group consisting of potassium nitrate, peroxides, manganese oxides and sulfur oxides, 1–200 parts by weight of urea, 1–5 parts by weight of a coating agent, 1–30 parts by weight of a binder, and 1–10 parts by weight of an anti-corrosion agent, based on 100 parts by weight of ammonium nitrate.

5. The method as set forth in claim 4, wherein the binder is one or more selected from the group consisting of starch, gelatin, glue, binding agents and 3-aminopropyltriethoxysilane.

6. The method as set forth in claim 4, wherein the coating agent is one or more selected from the group consisting of formaldehyde and Mg-stearate.

7. The method as set forth in claim 4, wherein the anti-corrosion agent is one or more selected from the group consisting of magnesium carbonate and calcium carbonate.

8. A method for on-line cleaning of heater tubes, comprising blasting, by a sand blasting technique, 30–95 wt % of a cleaning agent comprising ammnonium nitrate, formulated as a pellet having an average particle diameter of 2.5–8 mm and a particle density of 1.5–2 g/cm3, in combination with 5–70 wt % of an urea pellet having an average diameter of 1–5 mm to operating heater tubes at an injection pressure of 1–20 kg/cm2using air or nitrogen as a carrier medium.

9. The method as set forth in claim 8, wherein the cleaning agent further comprises 1–50 parts by weight of magnesium oxide, 1–50 parts by weight of inorganic cleaning agent which is one or more selected from the group consisting of potassium nitrate, peroxides, manganese oxides and sulfur oxides, 1–5 parts by weight of a coating agent, 1–30 parts by weight of a binder, and 1–10 parts by weight of an anti-corrosion agent, based on 100 parts by weight of ammonium nitrate.

* * * * *